US010779607B1

(12) United States Patent
Chandel

(10) Patent No.: US 10,779,607 B1
(45) Date of Patent: Sep. 22, 2020

(54) EXTENDIBLE SHOE

(71) Applicant: Nital Chandel, Tampa, FL (US)

(72) Inventor: Nital Chandel, Tampa, FL (US)

( * ) Notice: Subject to any disclaimer, the term of this patent is extended or adjusted under 35 U.S.C. 154(b) by 85 days.

(21) Appl. No.: 16/127,333

(22) Filed: Sep. 11, 2018

(51) Int. Cl.

| | |
|---|---|
| ***A43B 3/26*** | (2006.01) |
| ***A43B 23/02*** | (2006.01) |
| ***A43B 13/14*** | (2006.01) |
| ***A43B 1/00*** | (2006.01) |

(52) U.S. Cl.
CPC ..... *A43B 3/26* (2013.01); *A43B 13/141* (2013.01); *A43B 23/027* (2013.01); *A43B 1/0018* (2013.01)

(58) Field of Classification Search
CPC ..... A43B 3/26; A43B 13/24; A43B 3/248; A43B 5/004; A43B 5/12; A42B 3/30
See application file for complete search history.

(56) References Cited

U.S. PATENT DOCUMENTS

| | | | | |
|---|---|---|---|---|
| 3,142,911 A | | 8/1964 | Raborg | |
| 3,389,481 A | | 6/1968 | England | |
| 4,060,918 A | * | 12/1977 | Mandel | A43B 3/26 36/97 |
| 5,659,980 A | | 8/1997 | Lin | |
| 6,138,385 A | * | 10/2000 | Jungkind | A43B 1/0018 36/102 |
| 6,189,239 B1 | * | 2/2001 | Gasparovic | A43B 3/30 36/102 |
| 7,055,268 B2 | | 6/2006 | Ha | |
| 7,581,337 B2 | | 9/2009 | Miller | |
| 8,468,723 B2 | | 6/2013 | Malka-Harari | |
| 2003/0106244 A1 | * | 6/2003 | Miller | A43B 1/0072 36/97 |
| 2004/0107604 A1 | * | 6/2004 | Ha | A43B 1/0018 36/97 |
| 2010/0139122 A1 | | 6/2010 | Zanatta | |
| 2014/0041256 A1 | | 2/2014 | Espinola | |
| 2019/0380430 A1 | * | 12/2019 | Seid | A43B 3/24 |

* cited by examiner

*Primary Examiner* — Khoa D Huynh
*Assistant Examiner* — Erick I Lopez

(57) ABSTRACT

The extendible shoe is a footwear item. The extendible shoe has an adjustable length. The span of the length of the extendible shoe in the anterior-posterior direction adjusts such that the length of the extendible shoe is adjustable. The extendible show comprises an extendible sole and an extendible upper. The extendible upper attaches to the extendible sole. The extendible sole extends in the anterior-posterior direction. The extendible upper extends in the anterior-posterior direction.

6 Claims, 4 Drawing Sheets

EXTENDIBLE SHOE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of human necessities including footwear, more specifically, footwear adjustable as to length. (A43B3/26)

While footwear comes in many styles and forms, most commonly available footwear shares certain common characteristics including, but not limited to, an upper and a sole. The upper and sole are generally said to be attached at the feather. If the feather is reinforced with an additional piece of material, the additional piece of material is referred to as a welt. The upper is divided into a quarter region and a vamp region. The superior edge of the upper is called the top line (or collar). A foot typically enters footwear through the top line. The quarter region covers the heel of the foot. The vamp region covers the toes and attaches to the quarter. The sole is further defined with an insole and an outsole. The insole is the surface of the sole that is proximal to the foot when the footwear is worn normally. The outsole is the surface of the sole that is distal from the insole. The sole is often fitted with a heel, which is a structure that is designed to raise the quarter portion of the footwear above the vamp. The tongue is a flap of material that is attached to the upper such that the tongue is positioned between a foot and the upper. The tongue is attached to the upper at the frenulum.

SUMMARY OF INVENTION

The extendible shoe is a footwear item. The extendible shoe has an adjustable length. The span of the length of the extendible shoe in the anterior-posterior direction adjusts such that the length of the extendible shoe is adjustable. The extendible show comprises an extendible sole and an extendible upper. The extendible upper attaches to the extendible sole. The extendible sole extends in the anterior-posterior direction. The extendible upper extends in the anterior-posterior direction.

These together with additional objects, features and advantages of the extendible shoe will be readily apparent to those of ordinary skill in the art upon reading the following detailed description of the presently preferred, but nonetheless illustrative, embodiments when taken in conjunction with the accompanying drawings.

In this respect, before explaining the current embodiments of the extendible shoe in detail, it is to be understood that the extendible shoe is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the extendible shoe.

It is therefore important that the claims be regarded as including such equivalent construction insofar as they do not depart from the spirit and scope of the extendible shoe. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
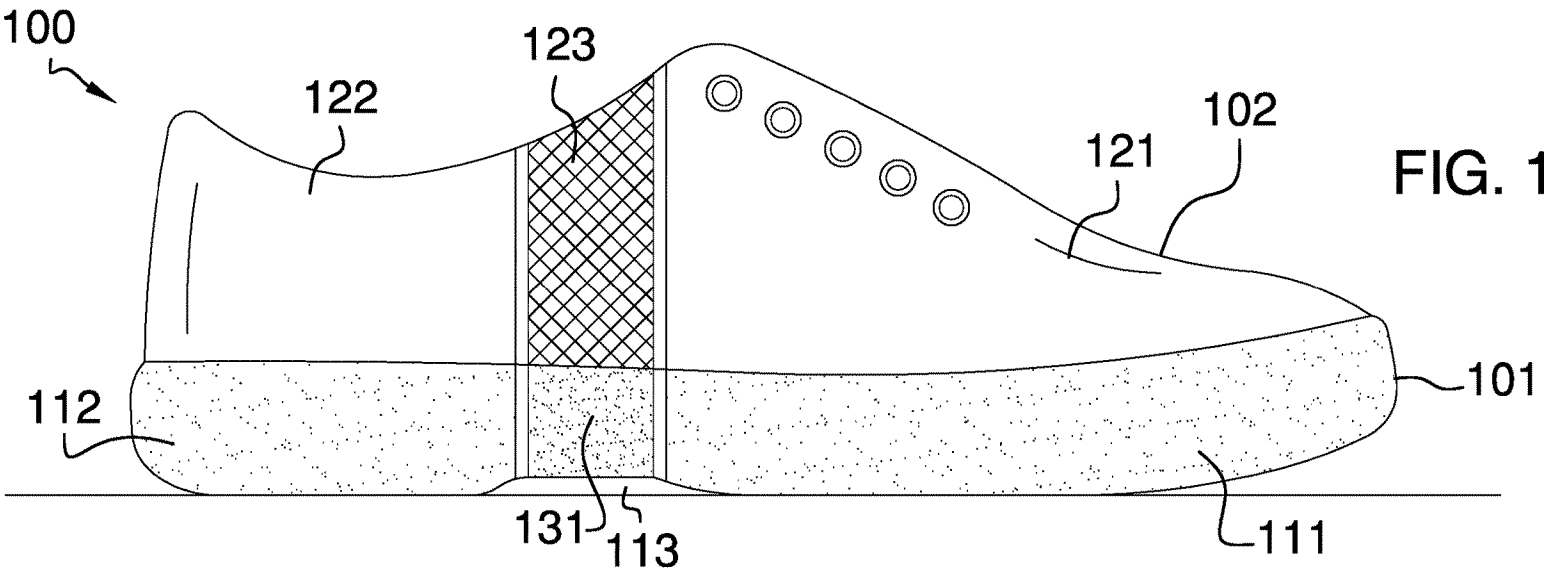
FIG. 1 is a side view (extended) of an embodiment of the disclosure.
Figure 2:
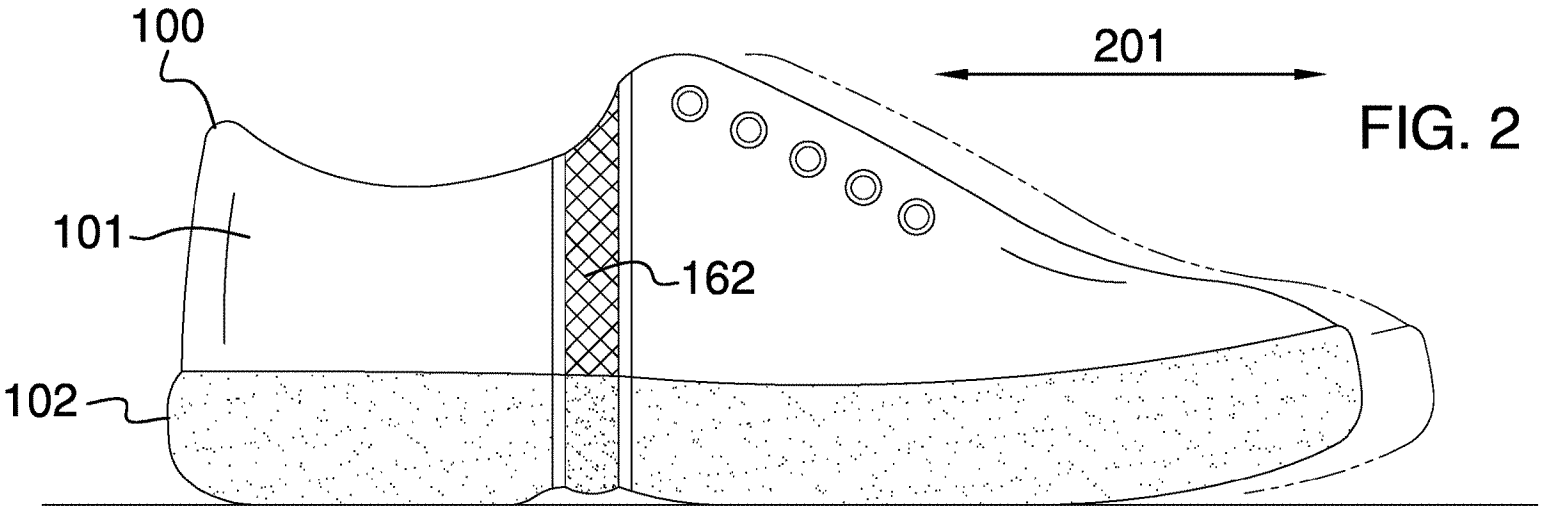
FIG. 2 is a side view (retracted) of an embodiment of the disclosure.
Figure 3:
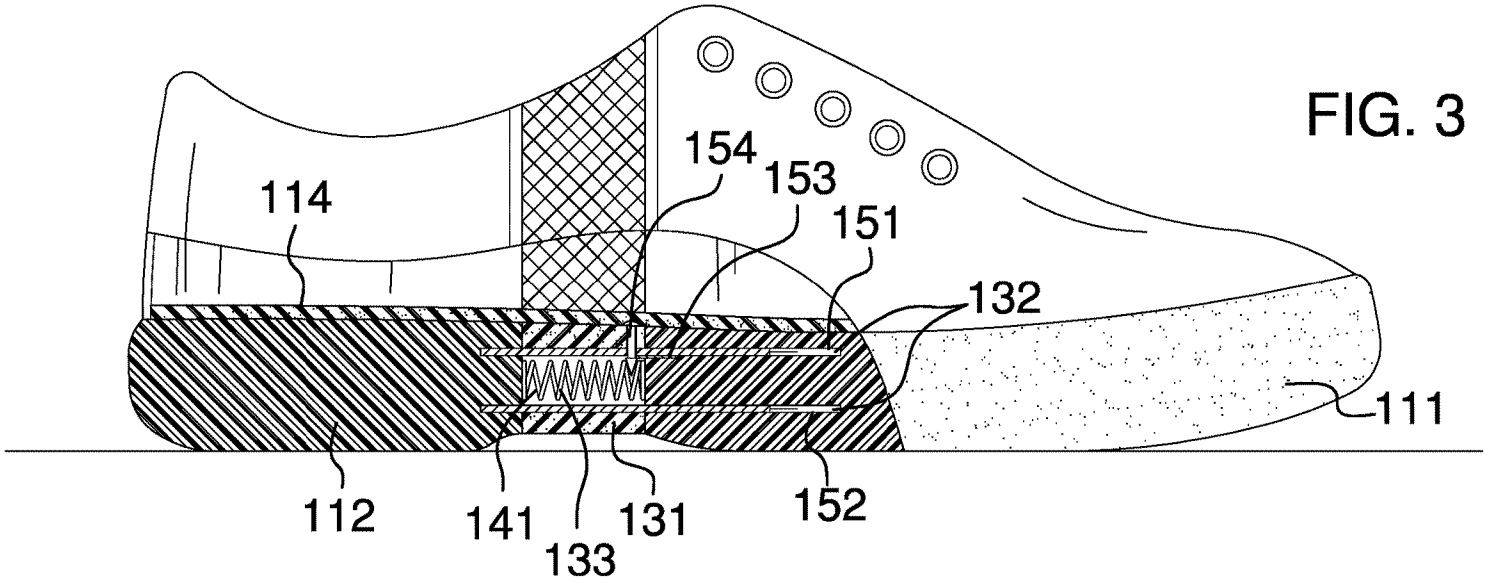
FIG. 3 is a side view (extended) of an embodiment of the disclosure.
Figure 4:
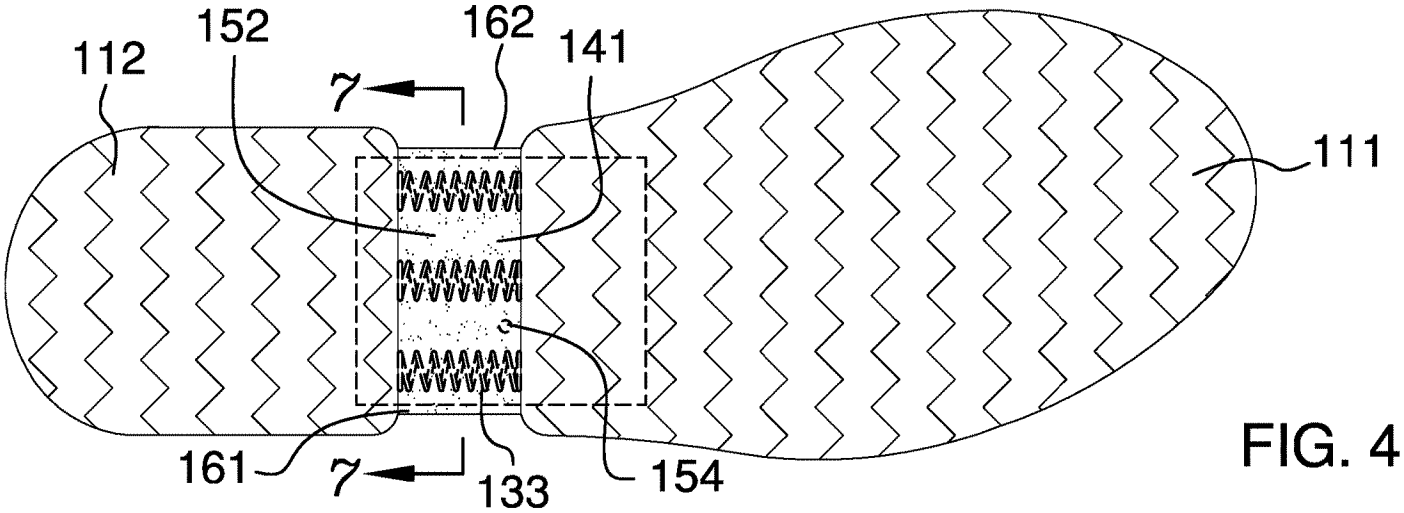
FIG. 4 is a bottom view (extended) of an embodiment of the disclosure.
Figure 5:
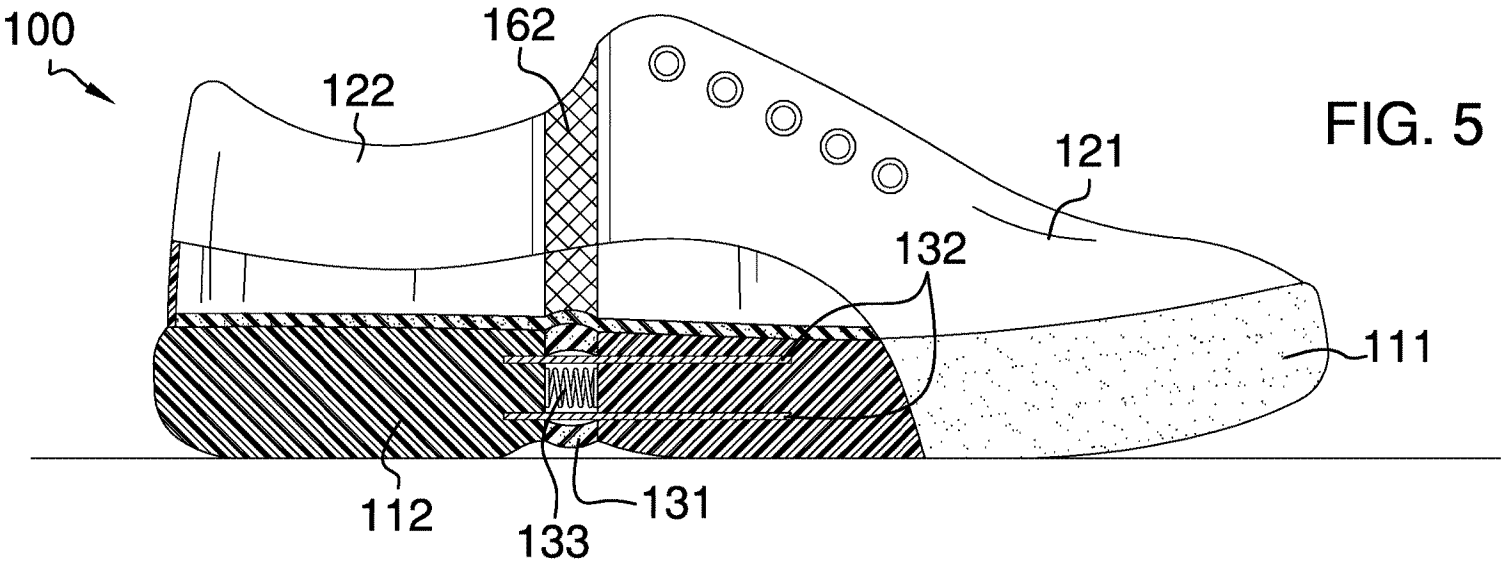
FIG. 5 is a side view (retracted) of an embodiment of the disclosure.
Figure 6:
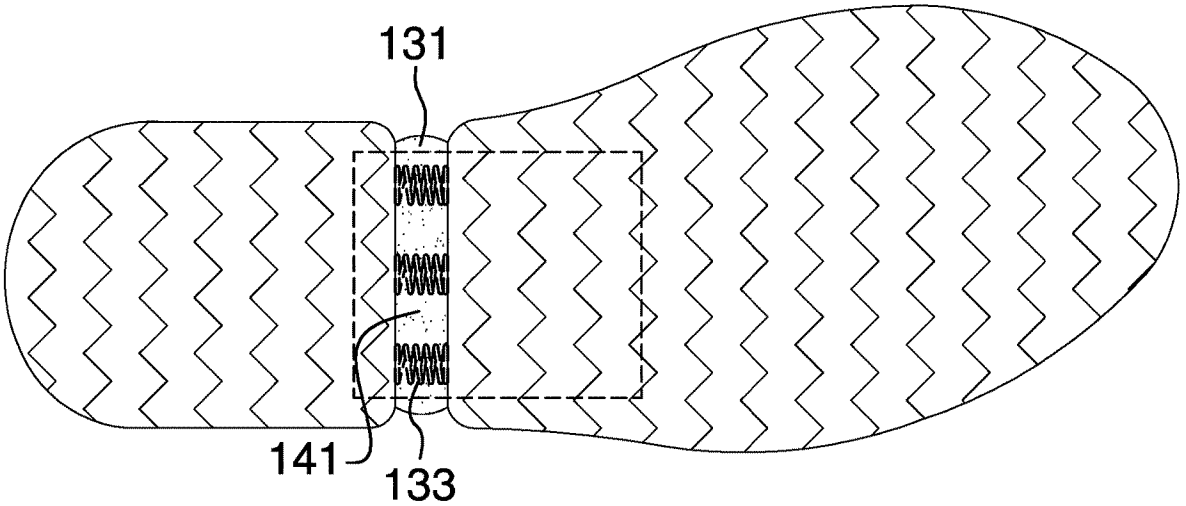
FIG. 6 is a bottom view (retracted) of an embodiment of the disclosure.
Figure 7:
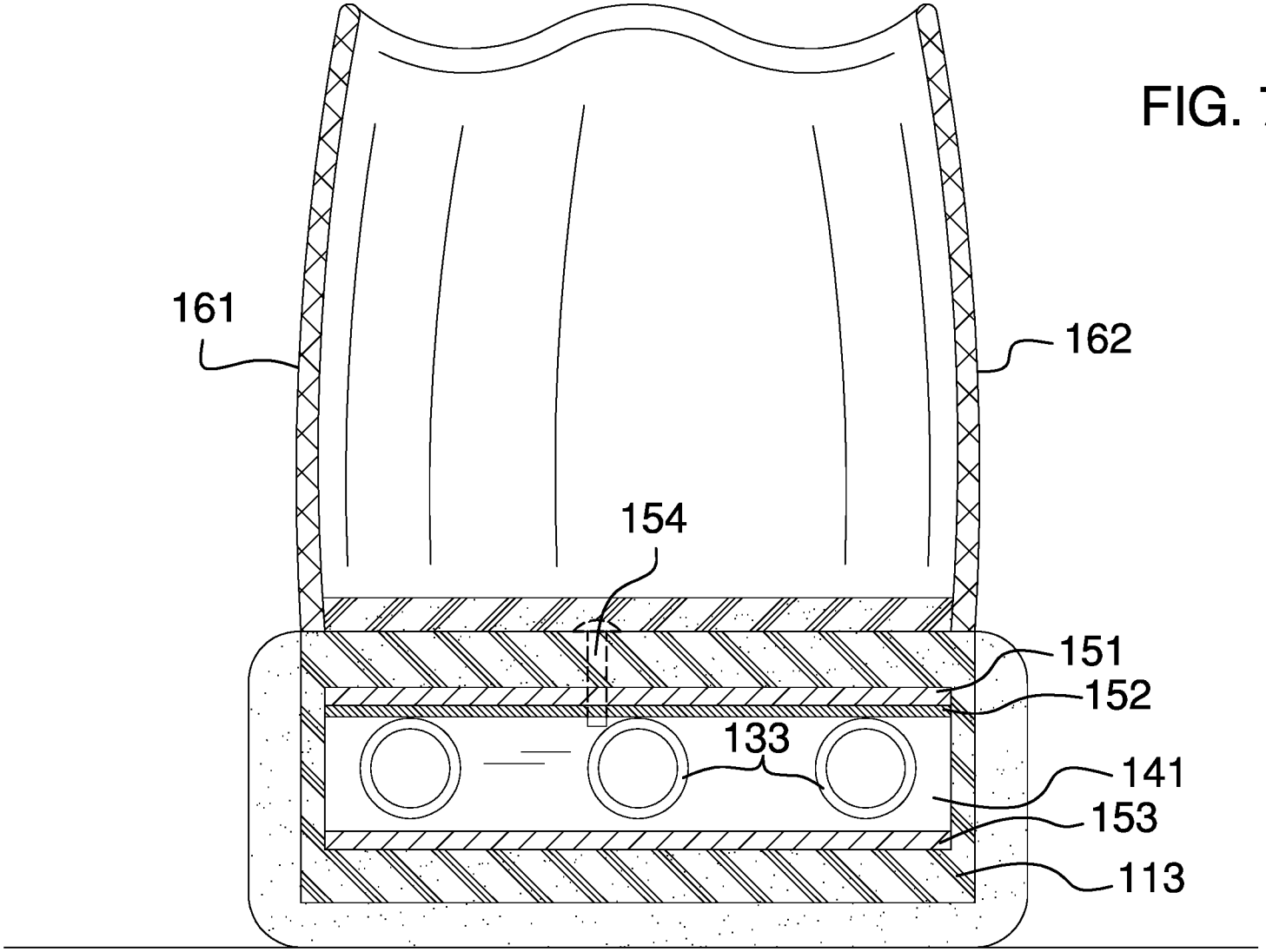
FIG. 7 is a cross-sectional view of an embodiment of the disclosure across 7-7 as shown in FIG. 4.

Detailed reference will now be made to one or more potential embodiments of the disclosure, which are illustrated in FIGS. 1 through 7.

The extendible shoe 100 (hereinafter invention) is a footwear item. The invention 100 has an adjustable length. The span of the length of the invention 100 in the anterior-posterior direction 201 adjusts such that the length of the invention 100 is adjustable. The extendible show comprises an extendible sole 101 and an extendible upper 102. The extendible upper 102 attaches to the extendible sole 101. The extendible sole 101 extends in the anterior-posterior direction 201. The extendible upper 102 extends in the anterior-posterior direction 201.

The extendible sole 101 forms the sole of the invention 100. The extendible sole 101 is an adjustable structure. The span of the length of the extendible sole 101 extends and retracts in the anterior-posterior direction 201 to fit the length of the foot of a wearer. The extendible sole 101 locks into position. The extendible sole 101 comprises an anterior sole 111, a posterior sole 112, an inferior extendible structure 113, and an insert 114.

The anterior sole 111 forms the anterior segment of the extendible sole 101. The anterior sole 111 forms the inferior element of the invention 100 that is positioned under the forefoot and the vamp 121 of the extendible upper 102.

The posterior sole 112 forms the posterior segment of the extendible sole 101. The posterior sole 112 forms the inferior element of the invention 100 that is positioned under the hind foot and the quarter 122 of the extendible upper 102.

The inferior extendible structure 113 is a mechanical structure that attaches the anterior sole 111 to the posterior sole 112. The inferior extendible structure 113 is an adjustable apparatus that allows the span of the length of the extendible sole 101 to adjust in the anterior-posterior direction 201. The inferior extendible structure 113 attaches the anterior sole 111 to the posterior sole 112 at a location inferior to the location where the superior extendible structure 123 attaches the vamp 121 to the quarter 122. The inferior extendible structure 113 is positioned underneath the arch of the foot. The inferior extendible structure 113 comprises a compression shell 131, a plurality of metal plates 132, and a plurality of springs 133.

The compression shell 131 is a roughly rectangular structure. The compression shell 131 is a hollow structure. The compression shell 131 forms the outer shell of the inferior extendible structure 113. The compression shell 131 is formed from an elastomeric material such that the compression shell 131 can be compressed in the anterior-posterior direction 201 by the application of a force. The compression shell 131 contains the plurality of springs 133. The compression shell 131 contains portions of each of the plurality of metal plates 132. The compression shell 131 comprises a rouleau 141. The rouleau 141 is a channel formed through the compression shell 131 in the anterior-posterior direction 201.

Each of the plurality of metal plates 132 is a rectangular metal plate installed in the extendible sole 101. Each of the plurality of metal plates 132 performs a function selected from the group consisting of: a) forming a beam structure that distributes the load path borne by the invention 100 through the anterior sole 111, the posterior sole 112, and the inferior extendible structure 113; and, b) locking the span of the length of the extendible sole 101 to a fixed length. The plurality of metal plates 132 comprises a superior plate 151, a medial plate 152, an inferior plate 153, and a cotter pin 154.

The superior plate 151 is a metal plate structure. The superior plate 151 is formed with a plurality of holes used to lock the span of the length of the extendible sole 101 into position. The superior plate 151 is rigidly fixed into the posterior sole 112. The superior plate 151 inserts into the anterior sole 111 such that the superior plate 151 slides into and out of the anterior sole 111 along the anterior-posterior direction 201. The superior plate 151 inserts through the rouleau 141 of the compression shell 131 such that the compression shell 131 can compress without interference from the superior plate 151.

The inferior plate 153 is a metal plate structure. The inferior plate 153 is rigidly fixed into the posterior sole 112. The inferior plate 153 inserts into the anterior sole 111 such that the inferior plate 153 slides into and out of the anterior sole 111 along the anterior-posterior direction 201. The inferior plate 153 inserts through the rouleau 141 of the compression shell 131 such that the compression shell 131 can compress without interference from the inferior plate 153.

The medial plate 152 is a metal plate structure. The medial plate 152 is formed with a plurality of holes used to lock the span of the length of the extendible sole 101 into position. The medial plate 152 is rigidly fixed into the anterior sole 111. The medial plate 152 inserts into the anterior sole 111 such that the medial plate 152 slides into and out of the rouleau 141 of the compression shell 131 along the anterior-posterior direction 201. The medial plate 152 inserts into the rouleau 141 of the compression shell 131 such that the medial plate 152 can compress without interference from the superior plate 151.

The cotter pin 154 is a metal pin that simultaneously inserts through a hole formed in the superior plate 151 and a hole formed in the medial plate 152. The cotter pin 154 fixes the position of the anterior sole 111 relative to the posterior sole 112 such that the span of the length of the invention 100 remains fixed. The cotter pin 154 inserts into the superior plate 151 and the medial plate 152 through the superior surface of the inferior extendible structure 113. The cotter pin 154 is cushioned using the insert 114.

The medial plate 152 is positioned directly underneath the superior plate 151 such that the cotter pin 154 can simultaneously insert through the superior plate 151 and the medial plate 152 to secure the anterior sole 111 in a fixed position relative to the posterior sole 112.

Each of the plurality of springs 133 is a compression spring. Each of the plurality of springs 133 attaches the posterior edge of the anterior sole 111 to the anterior edge of the posterior sole 112 by inserting through the rouleau 141 of the inferior extendible structure 113. Each of the plurality of springs 133 compresses when the span of the length of the extendible sole 101 is reduced. Each of the plurality of springs 133 moves towards its relaxed shape when the span of the length of the extendible sole 101 expands. Each of the plurality of springs 133 is fully relaxed when the span of the distance of the extendible sole 101 is at its maximum.

Each of the plurality of springs 133 pass through the rouleau 141 to attach the anterior sole 111 to the posterior sole 112. The superior plate 151 installs in the rouleau 141, the anterior sole 111, and the posterior sole 112 such that the superior plate 151 forms the superior surface of the rouleau 141. The inferior plate 153 installs in the rouleau 141, the anterior sole 111, and the posterior sole 112 such that the inferior plate 153 forms the inferior surface of the rouleau 141. The medial plate 152 installs in the rouleau 141 and the anterior sole 111 such that the medial plate 152 projects into the rouleau 141 from the anterior sole 111.

The insert 114 is an orthotic cushion that rests on the superior surface of the extendible sole 101.

The extendible upper 102 forms the upper of the invention 100. The extendible upper 102 is an adjustable structure. The span of the length of the extendible upper 102 extends and retracts in the anterior-posterior direction 201. The span of the length of the extendible upper 102 is set by the span of the length of the extendible sole 101. The extendible upper 102 comprises a vamp 121, a quarter 122, and a superior extendible structure 123.

The vamp 121 is the portion of the extendible upper 102 that creates an enclosed space over the anterior sole 111. The vamp 121 is the portion of the extendible upper 102 that encloses the forefoot. The use of a vamp 121 is well-known and documented in the shoemaking arts.

The quarter 122 is the portion of the extendible upper 102 that creates an enclosed space over the posterior sole 112. The quarter 122 is the portion of the extendible upper 102 that encloses the hind foot. The use of a quarter 122 is well-known and documented in the shoemaking arts.

The superior extendible structure 123 is an elastic structure that attaches the vamp 121 to the quarter 122. The superior extendible structure 123 is an adjustable apparatus that allows the span of the length of the extendible upper 102 to adjust in the anterior-posterior direction 201. The superior extendible structure 123 attaches to the extendible sole 101 at a location directly superior to the inferior extendible structure 113. The superior extendible structure 123 is positioned such that the superior extendible structure 123 is proximal to the talus of the foot. The superior extendible structure 123 comprises a left talus structure 161 and a right talus structure 162.

The left talus structure 161 is an elastic textile that attaches the left side of the vamp 121 to the left side of the quarter 122. The left talus structure 161 installs such that the left talus structure 161 stretches in the anterior-posterior direction 201. The left talus structure 161 adjusts the span of the length of the extendible upper 102 in concert with changes to the span of the length of the extendible sole 101. The right talus structure 162 is an elastic textile that attaches the right side of the vamp 121 to the right side of the quarter 122. The right talus structure 162 installs such that the right talus structure 162 stretches in the anterior-posterior direction 201. The right talus structure 162 adjusts the span of the length of the extendible upper 102 in concert with changes to the span of the length of the extendible sole 101.

The following definitions were used in this disclosure:

Ankle: As used in this disclosure, the ankle is the joint in the human body that joins the foot to the leg. The ankle comprises the lateral malleolus region of the fibula, the medial malleolus region of the tibia, and the talus. The talus attaches the lateral malleolus region of the fibula and the medial malleolus region of the tibia to the hind foot region of the foot.

Anterior: As used in this disclosure, anterior is a term that is used to refer to the front side or direction of a structure. When comparing two objects, the anterior object is the object that is closer to the front of the structure.

Arch: As used in this disclosure, an arch refers to an edge or surface that forms a concave edge or surface of a definable negative space.

Arch: As used in this disclosure, the arch refers to an arch formed in the foot proximal to the talus and metatarsal bones. The form of the arch helps to support and distribute the weight borne by the foot.

Ball of the Foot: As used in this disclosure, the ball of the foot is a padded area on the bottom of the foot of a person located between the toes and the arch of the foot. When the heel of the foot is raised, the ball of the foot supports the weight of the person.

Compression Spring: As used in this disclosure, a compression spring is a spring that resists forces attempting to compress the spring in the direction of the center axis of the spring. The compression spring will return to its original position when the compressive force is removed.

Cotter Pin: As used in this disclosure, a cotter pin is a metal shaft that is used to hold two mechanical components together.

Detent: As used in this disclosure, a detent is a device for positioning and holding a first object relative to a second object such that the position of the first object relative to the second object is adjustable.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Textile: As used in this disclosure, an elastic textile is a textile that contains elastic yarns as some of the yarns that make up the textile. An elastic textile is constructed such that the elastic textile will stretch when a force is applied and will return to its original shape when after the force is removed.

Feather: As used in this disclosure, the feather is the junction between the upper and the sole.

Foot: As used in this disclosure, the foot refers to the portion of the leg that is below the ankle. Within this disclosure, the foot is further defined with a forefoot, a midfoot, a hind foot, and a sole. The forefoot is the region of the foot is the anterior portion of the foot within which the phalanges and the metatarsals bones are located. The midfoot is the region of the foot within which the navicular, cuboid, and cuneiform bones are located. The hind foot is the region of the foot that is posterior to the midfoot. The sole refers to the inferior surfaces of the foot located underneath the forefoot, the midfoot, and the hind foot. The healthy foot further comprises five toes formed at the distal end of the forefoot.

Footwear: As used in this disclosure, footwear refers to a protective structure that is worn on a foot. Footwear is commonly referred to as a shoe.

Frenulum: As used in this disclosure, the frenulum is the junction between the tongue and the upper where the tongue is connected to the upper.

Ground: As used in this disclosure, the ground is a solid supporting surface formed by the Earth. The term level ground means that the supporting surface formed by the ground is roughly perpendicular to the force of gravity.

Heel: As used in this disclosure, the heel is the portion of the sole or the outsole that is underneath the ankle and posterior to the arch of the foot of the wearer.

Inferior: As used in this disclosure, the term inferior refers to a directional reference that is parallel to and in the same direction as the force of gravity when an object is positioned or used normally.

Insert: As used in this disclosure, an insert is an orthotic cushion that inserts into footwear such that the insert rests on the insole of the footwear. The insert forms a structure between the foot and the insole.

Insole: As used in this disclosure, the insole is the component of a shoe sole that is proximal to the wearer's foot.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Medial: As used in this disclosure, the term medial is used to describe a third object relative to the position of a first object and a second object. The third object is positioned such that: a) the span of the distance from the third object to the first object is lesser than the span of the distance between the first object and the second object; and, b) the span of the distance from the third object to the second object is lesser than the span of the distance between the first object and the second object. The third object would commonly be said to be between the first object and the second object.

Negative Space: As used in this disclosure, negative space is a method of defining an object through the use of open or empty space as the definition of the object itself, or, through the use of open or empty space to describe the boundaries of an object.

Plate: As used in this disclosure, a plate is a smooth, flat and semi-rigid or rigid structure that has at least one dimension that: a) is of uniform thickness; and b) that appears thin relative to the other dimensions of the object. Plates often have a rectangular or disk like appearance. The face of the plate is a surface of the plate selected from the group consisting of: a) the surface of the plate with the greatest surface area; b) the surface of the plate that is distal from the surface of the plate with the greatest surface area. The edges of the plate comprise the surfaces of the plate that would not be considered faces as defined above. As defined in this disclosure, plates may be made of any material, but are commonly made of metal, plastic, and wood. When made of wood, a plate is often referred to as a board.

Posterior: As used in this disclosure, posterior is a term that is used to refer to the side of an object that is distal or in the opposite direction of the anterior side. When comparing two items, the posterior item is the item that is distal from the anterior of the object.

Outsole: As used in this disclosure, the outsole is the outer component of the sole of the shoe that is in contact with the ground.

Quarter: As used in this disclosure, the quarter is the portion of the upper that is connected to the vamp and that surrounds the heel and the sides of the foot.

Relaxed Shape: As used in this disclosure, a structure is considered to be in its relaxed state when no shear, strain, or torsional forces are being applied to the structure.

Rigid Structure: As used in this disclosure, a rigid structure is a solid structure formed from an inelastic material that resists changes in shape. A rigid structure will permanently deform as it fails under a force.

Rouleau: As used in this disclosure, a rouleau is a tube or channel that is formed through a structure.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Sole: As used in this disclosure, the sole component of a shoe that forms the undersurface of the shoe and comes in contact with the ground.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Textile: As used in this disclosure, a textile is a material that is woven, knitted, braided or felted. Synonyms in common usage for this definition include fabric and cloth.

Tongue: As used in this disclosure, the tongue is the portion a shoe that is attached to the vamp such that the tongue sits underneath the upper and underneath the fastener (such as shoelaces) used to tighten the shoe.

Top Line: As used in this disclosure, the top line is the superior edge of the upper. The foot is generally inserted into an upper at the top line. The top line is often referred to as the collar.

Upper: As used in this disclosure, the upper is the portion of the shoe that is superior to the sole.

Vamp: As used in this disclosure, the vamp is the portion of the upper that covers the superior portion of the foot from the toes to where the vamp connects to the quarter.

Welt: As used in this disclosure, a welt is a piece of material that reinforces the attachment of the upper to the sole.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An extendible footwear item comprising:

an extendible sole and an extendible upper;

wherein the extendible upper attaches to the extendible sole;

wherein the extendible sole forms the sole of the extendible footwear item;

wherein the extendible upper forms the upper of the extendible footwear item;

wherein the extendible footwear item is further defined with an anterior-posterior direction;

wherein the span of the length of the extendible footwear item in the anterior-posterior direction adjusts such that the length of the extendible footwear item is adjustable;

wherein the span of the length of the extendible sole extends and retracts in the anterior-posterior direction; wherein the span of the length of the extendible upper extends and retracts in the anterior-posterior direction;

wherein the extendible sole is an adjustable structure;
wherein the extendible sole locks into position;
wherein the extendible upper is an adjustable structure;
wherein the span of the length of the extendible upper is set by the span of the length of the extendible sole;
2wherein the extendible sole comprises an anterior sole, a posterior sole, an inferior extendible structure, and an insert;
wherein the inferior extendible structure attaches the anterior sole to the inferior sole;
wherein the insert is an orthotic cushion that rests on a superior surfaces of the of the anterior sole, the posterior sole, and the inferior extendible structure;
wherein the anterior sole forms the anterior segment of the extendible sole;
wherein the posterior sole forms the posterior segment of the extendible sole;
wherein the inferior extendible structure is a mechanical structure that attaches the anterior sole to the posterior sole;
wherein the inferior extendible structure is an adjustable apparatus;
wherein the inferior extendible structure allows the span of the length of the extendible sole to adjust in the anterior-posterior direction;
wherein the inferior extendible structure comprises a compression shell, a plurality of metal plates, and a plurality of springs;
wherein the plurality of metal plates and the plurality of springs insert into the compression shell;
wherein the plurality of plates attach the anterior sole to the posterior sole;
wherein the compression shell contains the plurality of springs;
wherein the compression shell contains portions of each of the plurality of metal plates;
wherein the compression shell is formed from an elastomeric material such that the compression shell that is compressed in the anterior-posterior direction by the application of a force;
wherein the compression shell comprises a rouleau;
wherein the rouleau is a channel formed through the compression shell in the anterior-posterior direction;
wherein each of the plurality of metal plates is a rectangular metal plate installed in the extendible sole;
wherein each of the plurality of metal plates performs a function selected from the group consisting of: a) forming a beam structure that distributes the load path borne by the extendible footwear item through the anterior sole, the posterior sole, and the inferior extendible structure; and, b) locking the span of the length of the extendible sole to a fixed length;
wherein the plurality of metal plates comprises a superior plate, a medial plate, an inferior plate, and a cotter pin;
wherein the superior plate attaches the anterior sole and the posterior sole;
wherein the inferior plate attaches the anterior sole and the posterior sole;
wherein the medial plate attaches to the anterior sole;
wherein the cotter pin attaches the medial plate to the superior plate;
wherein the superior plate is a metal plate structure;
wherein the inferior plate is a metal plate structure;
wherein the medial plate is a metal plate structure;
wherein the superior plate is formed with a plurality of holes that set the span of the length of the extendible sole into position;
wherein the medial plate is formed with a plurality of holes that set the span of the length of the extendible sole into position;
wherein the superior plate is rigidly fixed into the posterior sole;
wherein the inferior plate is rigidly fixed into the posterior sole;
wherein the medial plate is rigidly fixed into the anterior sole;
wherein the superior plate inserts into the anterior sole such that the superior plate slides into and out of the anterior sole along the anterior-posterior direction;
wherein the inferior plate inserts into the anterior sole such that the inferior plate slides into and out of the anterior sole along the anterior-posterior direction;
wherein the medial plate inserts into the anterior sole such that the medial plate slides into and out of the rouleau of the compression shell along the anterior-posterior direction;
wherein the superior plate installs in the rouleau, the anterior sole, and the posterior sole such that the superior plate forms the superior surface of the rouleau;
wherein the inferior plate installs in the rouleau, the anterior sole, and the posterior sole such that the inferior plate forms the inferior surface of the rouleau;
wherein the medial plate installs in the rouleau and the anterior sole such that the medial plate projects into the rouleau from the anterior sole;
wherein the superior plate inserts through the rouleau of the compression shell such that the compression shell can compress without interference from the superior plate;
wherein the inferior plate inserts through the rouleau of the compression shell such that the compression shell can compress without interference from the inferior plate;
wherein the medial plate inserts into the rouleau of the compression shell such that the medial plate can compress without interference from the superior plate;
wherein the cotter pin is a metal pin that simultaneously inserts through a hole formed in the superior plate and a hole formed in the medial plate;
wherein the medial plate is positioned directly underneath the superior plate such that the cotter pin can simultaneously insert through the superior plate and the medial plate to secure the anterior sole in a fixed position relative to the posterior sole;
wherein the cotter pin sets the position of the anterior sole relative to the posterior sole such that the span of the length of the extendible footwear item remains fixed;
wherein the cotter pin inserts into the superior plate and the medial plate through the superior surface of the inferior extendible structure;
wherein the cotter pin is cushioned using the insert;
wherein each of the plurality of springs is a compression spring;
wherein each of the plurality of springs attaches the posterior edge of the anterior sole to the anterior edge of the posterior sole by inserting through the rouleau of the inferior extendible structure;
wherein each of the plurality of springs compresses when the span of the length of the extendible sole is reduced;
wherein each of the plurality of springs moves towards its relaxed shape when the span of the length of the extendible sole expands;

wherein each of the plurality of springs is fully relaxed when the span of the distance of the extendible sole is at its maximum;

wherein each of the plurality of springs pass through the rouleau to attach the anterior sole to the posterior sole.

2. The extendible footwear item according to claim 1 wherein the compression shell is a hollow structure;

wherein the compression shell forms an the outer shell of the inferior extendible structure.

3. The extendible footwear item according to claim 2 wherein the extendible upper comprises a vamp, a quarter, and a superior extendible structure;

wherein the vamp, the quarter, and the superior extendible structure attach to the extendible sole;

wherein the superior extendible structure attaches the vamp to the quarter;

wherein the anterior sole forms the inferior element of the extendible footwear item that is positioned at a location inferior to the vamp of the extendible upper;

wherein the posterior sole forms the inferior element of the extendible footwear item that is positioned at a location inferior to the quarter of the extendible upper;

wherein the inferior extendible structure attaches the anterior sole to the posterior sole at a location inferior to the location where the superior extendible structure attaches the vamp to the quarter.

4. The extendible footwear item according to claim 3 wherein the superior extendible structure is an elastic structure;

wherein the superior extendible structure is an adjustable apparatus that allows the span of the length of the extendible upper to adjust in the anterior-posterior direction;

wherein the superior extendible structure is positioned such that the superior extendible structure is adapted to be proximal to the talus of a foot.

5. The extendible footwear item according to claim 4 wherein the superior extendible structure comprises a left talus structure and a right talus structure;

wherein the left talus structure is an elastic textile that attaches the left side of the vamp to the left side of the quarter;

9wherein the right talus structure is an elastic textile that attaches the right side of the vamp to the right side of the quarter.

6. The extendible footwear item according to claim 5 wherein the left talus structure installs such that the left talus structure stretches in the anterior-posterior direction;

wherein the right talus structure installs such that the right talus structure stretches in the anterior-posterior direction;

wherein the left talus structure adjusts the span of the length of the extendible upper in concert with changes to the span of the length of the extendible sole;

wherein the right talus structure adjusts the span of the length of the extendible upper in concert with changes to the span of the length of the extendible sole.

* * * * *